US009987539B2

(12) United States Patent
Shaw

(10) Patent No.: US 9,987,539 B2
(45) Date of Patent: Jun. 5, 2018

(54) ORBITING BOB TOY HAVING MODULAR BOBS WITH A RECESSED THROUGHBORE SHEATH AND CUSTOMIZABLE WEIGHTING

(71) Applicant: Laurence J. Shaw, San Francisco, CA (US)

(72) Inventor: Laurence J. Shaw, San Francisco, CA (US)

( * ) Notice: Subject to any disclaimer, the term of this patent is extended or adjusted under 35 U.S.C. 154(b) by 0 days. days.

(21) Appl. No.: 15/063,473

(22) Filed: Mar. 7, 2016

(65) Prior Publication Data

US 2016/0332051 A1 Nov. 17, 2016

Related U.S. Application Data

(60) Provisional application No. 62/129,767, filed on Mar. 7, 2015.

(51) Int. Cl.
*A63H 1/06* (2006.01)
*A63B 67/10* (2006.01)

(52) U.S. Cl.
CPC ..... *A63B 67/10* (2013.01); *A63B 2209/00* (2013.01)

(58) Field of Classification Search
USPC ..... 446/215, 247, 252, 489, 490
See application file for complete search history.

(56) References Cited

U.S. PATENT DOCUMENTS 1,932,943 A * 10/1933 Smith ..... A63B 67/10 446/247
2,161,154 A * 6/1939 Gertler ..... A63H 1/32 446/253
4,813,685 A * 3/1989 Gaston ..... A63F 7/382 473/576
RE34,208 E * 3/1993 Shaw ..... A63B 67/10 426/104
6,332,851 B1 * 12/2001 Griffin ..... A63B 67/10 273/440
6,629,873 B2 * 10/2003 Shaw ..... A63B 67/10 446/242
6,896,578 B2 * 5/2005 Shaw ..... A63B 43/007 446/247
7,137,863 B2 * 11/2006 Hiebert ..... A63B 67/16 446/242
9,004,978 B2 * 4/2015 Shaw ..... A63B 67/08 446/247

* cited by examiner

*Primary Examiner* — Kurt Fernstrom
(74) *Attorney, Agent, or Firm* — Integral Patent Associates; Laurence J. Shaw

(57) ABSTRACT

A swinging bob toy having three bobs constrained to a string with at least the center bob being slideable along the string. Each bob is modular and consists of two hemispheric elastomeric mantle pieces, a three-component throughbore sheath, and one or two hex nuts mounted on a threaded central component of the throughbore sheath. The two end components of the throughbore sheath are flared and are non-elastomeric, while the threaded central component is elastomeric. The outside ends of the flared end components of the sheath are recessed relative to the mouths of the throughbore so that all exterior impact surfaces of the bob are elastomeric. The string has a circular cross-section and has a width greater than 50% of the width of the narrowest diameter of the throughbore.

14 Claims, 13 Drawing Sheets

ORBITING BOB TOY HAVING MODULAR BOBS WITH A RECESSED THROUGHBORE SHEATH AND CUSTOMIZABLE WEIGHTING

RELATED APPLICATIONS

The present application is based on and claims the priority of provisional patent application Ser. No. 62/129,767, filed on Mar. 7, 2015, by the same inventor (i.e., Laurence J. Shaw), entitled "Orbiting bob toy having modular bobs with a recessed throughbore sheaf and customizable weighting."

FIELD OF THE INVENTION

The present invention relates to toys having swinging/orbiting bobs on a string, and more particularly to toys having swinging/orbiting bobs on a string where at least one of the bobs is slideable along the string. The present invention also relates to modular and/or customizable toys.

BACKGROUND OF THE INVENTION

U.S. Pat. No. RE34,208 teaches a swinging bob toy having three bobs on a string with the middle bob being slideable and constrained on the string between the two end bobs. This toy has been sold under the trademark Astrojax® for over 20 years. A number of varieties of the toy have been marketed, including foam-mantled versions, light-up versions, a version with liquid-filled bobs, and a modular version. Holding one end bob, the basic orbits are a vertical orbit, a horizontal orbit and a figure-eight or "butterfly" pattern. The vertical orbit is the most fundamental orbit since it is generally the orbit which beginners first learn and master, and many advanced maneuvers are based on the vertical orbit. Players have developed a large number of tricks and maneuvers with the toy, many of which can be viewed in the thousands of videos players have posted on www.YouTube.com. A disadvantage of some versions of this toy is that the weight, appearance, slidability and other characteristics of the bobs are not customizable.

Another disadvantage of previously-marketed versions of the swinging bob toy is that, because the string is narrow compared with the width of a bob throughbore at its narrowest, play becomes increasingly degraded as knots accumulate in the string due to careless storage or handling of the toy. An overhand knot is shown in FIG. 10A in an untightened configuration and in FIG. 10B an overhand knot is shown in a tightened configuration. The overhand knot is the simplest of all knots and the most likely to inadvertently form in the string of the toy due to careless handling or storage. (An overhand knot can also form in the string during play, although that is somewhat unlikely.) Even if the knots in the string are noticed, they are hard to remove from thin braided nylon string.

In the original foam version of the toy sold under the trademark Astrojax® by New Toy Classics of San Francisco, Calif. in the 1990s, and the V-Max™ and Saturn™ versions of the swinging bob toy which was sold by Active People of Binningen, Switzerland, the string was made of a braided nylon nominally labeled as having a "1/16 inch" diameter (i.e., a nominal diameter of 1.588 mm), and the bore diameter of a bob at its narrowest was 3.175 mm. However, when compressed by a force of 20 grains (i.e., compressed transversely under normal conditions of play while sliding through the bore by what is equivalent to the weight of a bob) the string had a thickness of 1 mm across the direction of the compression. Therefore, the ratio of (i) the string width when compressed (transversely) by a force equal to the weight of a bob to (ii) the throughbore diameter at its narrowest was less than 0.33. Given that an overhand knot has a width which is roughly three times the compressed width of the string, a knot in the string can slide through the bore of the bob. However, when a knot slides through the bore, and particularly on first impact with the throughbore, the sliding friction increases, negatively impacting the feel of play with the toy. This effect is compounded as the number of overhand knots increases.

In the Aqua™ version of the swinging bob toy, which was sold by Active People of Binningen, Switzerland, the string was made of a braided nylon with a circular-cross section weave with a diameter of 1.8 mm when uncompressed. When compressed by a force of 28 grams (i.e., compressed transversely under normal conditions of play while sliding through the bore by what is equivalent to the weight of a bob) the string had a thickness of 1.4 mm across the direction of the compression. The bore diameter of a bob at its narrowest was 3.4 mm. Therefore, the ratio of (i) the string width when compressed (transversely) by a force equal to the weight of a bob to (ii) the throughbore diameter at its narrowest was less than 0.45. A well-tightened overhand knot formed in the string has a maximum width of just about or slightly less than the width of the bore and can pass through the bore. Therefore, when a knot slides through the bore, and particularly on first impact with the throughbore, the sliding friction increases, negatively impacting the feel of play with the toy. Furthermore, an overhand knot cannot be used as an end stopper to reliably constrain the bobs to the string.

Another disadvantage of some versions of this swinging bob toy is that the exterior impact surfaces of the bobs (i.e., the surfaces of the bobs that may impact the surroundings during operation of the toy) are hard and impact with the player can be unpleasant. One previously-marketed version of the swinging bob toy where the majority of the exterior impact surface is soft is a liquid-filled version which has been sold under the trademark Aqua™ and is described in detail in U.S. Pat. No. 6,896,578. (Reference numerals used in this paragraph refer to U.S. Pat. No. 6,896,578.) As is shown in FIG. 6A of U.S. Pat. No. 6,896,578 and described in column 5, lines 35-60, this version has a liquid-filled bladder (650) and a non-elastomeric throughbore sheath (630). Although a majority of the exterior surface which can impact the surroundings, including the player, (i.e., the "exterior impact surface") is soft, the top and bottom ends of the throughbore sheath (630) are also part of the exterior impact surface, and they are non-elastomeric. The throughbore sheath (630) was designed in this version to extend to the exterior impact surface because it was believed that it was important to have a low sliding friction over the entirety of the throughbore (631) to optimize the feel of play with the toy.

A modular version of the swinging bob toy has been sold under the trademark MX™ and is described in detail in U.S. Pat. No. 9,004,978. (Reference numerals used in this paragraph refer to U.S. Pat. No. 9,004,978.) As is shown in FIG. 2A of U.S. Pat. No. 9,004,978 and described from column 3, lines 31 to column 4, line 27, this version also has a non-elastomeric throughbore sheath (140). Although a majority of the exterior surface which might impact the surroundings, including the player, (i.e., the "exterior impact surface") is soft, the top and bottom ends of the throughbore sheath (140) are also part of the exterior impact surface, and impact of the ends of the throughbore sheath (140) with the player during play may be unpleasant. Again, the throughbore sheath (140) was designed in this version to extend into the exterior impact surfaces because it was believed that it was important to have a low coefficient of sliding friction over the entirety of the throughbore (140) to optimize the feel of play with the toy. Another limitation of this modular version is that, although it allows cosmetic customizations, it does not allow functional customizations such as customizations to change the weight or mass distribution of the bobs. Furthermore, its modular components are all components that are manufactured for this product.

Another swinging bob toy with three bobs is sold online at www.freedo.info under the trademark TriThology™. The bobs of this toy are slidably constrained to a looped string by small metallic hooks or loops connected to the bobs by swivels, and so the bobs have their centers of mass displaced from the string. Holding one end bob, the basic orbits are a horizontal orbit and vertical oscillations, and there is also a horizontal orbit with superimposed vertical oscillations. Because the three bobs have the same mass, the orbits have a balanced feel and appearance. Disadvantages of this toy include that the weight, appearance, slidability and other characteristics of the bobs are not customizable.

A swinging bob toy with two sliding bobs on a tethering means is described in U.S. Pat. No. 7,137,863. This toy is sold by Yomega Corporation of Seekonk, Mass. under the trademark Monkey Knuckles™, and videos showing its use can be found on www.YouTube.com. Although the bobs have throughbores through which the string passes so the bobs can slide on the string, the throughbores of Monkey Knuckles™ are straighter and provide more friction than the flared bores of Astrojax® bobs, so Monkey Knuckles™ bobs do not slide as easily as Astrojax® bobs. This feature of the design of the bobs allows tricks and maneuvers where friction plays a role in the stability of the motion. A disadvantage of this toy is that the bobs are hard and their impact with the player can be unpleasant. Another limitation of the toy is that the weight, appearance, slidability and other characteristics of the bobs are not customizable.

It is therefore an object of the present invention to provide a swinging bob toy with bobs which have exterior impact surfaces (i.e., the surfaces of the bobs that may impact the surroundings during operation of the toy) which are soft or elastomeric over their entirety.

It is another object of the present invention to provide a swinging bob toy where non-elastomeric components of the bobs are mounted in and/or shielded by cushioning elastomeric components, particularly where the elastomeric components are designed to absorb and dissipate impact shocks.

More particularly, it is an object of the present invention to provide a swinging bob toy where a bob has a non-elastomeric throughbore sheath, and particularly where the throughbore sheath does not extend to the exterior impact surfaces of the bob.

It is another object of the present invention to provide a swinging bob toy which is modular.

More particularly, it is an object of the present invention to provide a swinging bob toy which is modular, and its modular components include easily-available components produced by third-party manufacturers, particularly components widely available at retail outlets such as hardware stores.

More particularly, it is an object of the present invention to provide a modular swinging bob toy where the weight and/or mass distribution is customizable.

Furthermore, it is an object of the present invention to provide a modular swinging bob toy where modular components can be used for different versions of the toy.

More particularly, it is an object of the present invention to provide a swinging bob toy where a dimensionless ratio inversely proportional to a moment of inertia can be made large to result in good play/operation.

It is another object of the present invention to provide a swinging bob toy with an alterable geometry/construction.

It is another object of the present invention to provide a swinging bob toy where play does not incrementally degrade as knots accumulate in the string.

It is another object of the present invention to provide a swinging bob toy where a functional component of the toy (in addition to the string) can be implemented by the string.

More particularly, it is an object of the present invention to provide a swinging bob toy where an end stoppers constraining the bobs to the string can be created from an overhand knot.

It is another object of the present invention to provide a swinging bob toy where the length of the string is easily adjustable.

It is another object of the present invention to provide a swinging bob toy which is safe and durable.

It is another object of the present invention to provide a swinging bob toy with a middle/sliding-pivot bob having a throughbore with a non-uniform coefficient of sliding friction, particularly for the purpose of promoting smoothness of operation.

Additional objects and advantages of the invention will be set forth in the descriptions which follow, and will be obvious from the descriptions or may be learned by practice of the invention. The objects and advantages of the invention may be realized and obtained by means of the instrumentalities and combinations particularly pointed out in the claims.

SUMMARY OF THE INVENTION

The present invention is directed to a swinging bob toy having a tethering means, a first bob and a second bob. The second bob has a throughbore through which the tethering means passes to allow the second bob to slide on the tethering means. The first bob is constrained to the tethering means between a first end of the tethering means and the second bob. The second bob has an elastomeric exterior surface. The second bob includes a non-elastomeric throughbore sheath which provides a non-elastomeric central region of the throughbore of the second bob. The elastomeric surface extends into the throughbore to provide elastomeric regions at each end of the throughbore.

The present invention is also directed to a swinging bob toy having a tethering means, a first bob and a second bob. The second bob has two elastomeric hemispheric mantles, each with a throughbore along a polar axis normal to the equatorial surface, and each having a hollow centered on the polar axis and extending to the equatorial surface. The second bob also has a weight having dimensions small enough to fit in the hollows when the equatorial surfaces of the hemispheric mantles abut. The second bob also has a pair of non-elastomeric flared throughbore sheaths, and a securing mechanism which secures the hemispheric mantles together with their equatorial surfaces abutting and the flared throughbore sheaths in the throughbores of the hemispheric mantles, and with the weight in the hollows.

The present invention is also directed to a swinging bob toy having a tethering means, a first bob and a second bob.

The tethering means passes through a throughbore in the second bob and the second bob is slideable on the tethering means. The first bob is constrained to the tethering means between a first end of the tethering means and the second bob. The width of the tethering means where the second bob slides is greater than 50% of the narrowest width of the throughbore of the second bob.

DETAILED DESCRIPTION OF THE PREFERRED EMBODIMENTS

Figure 1:
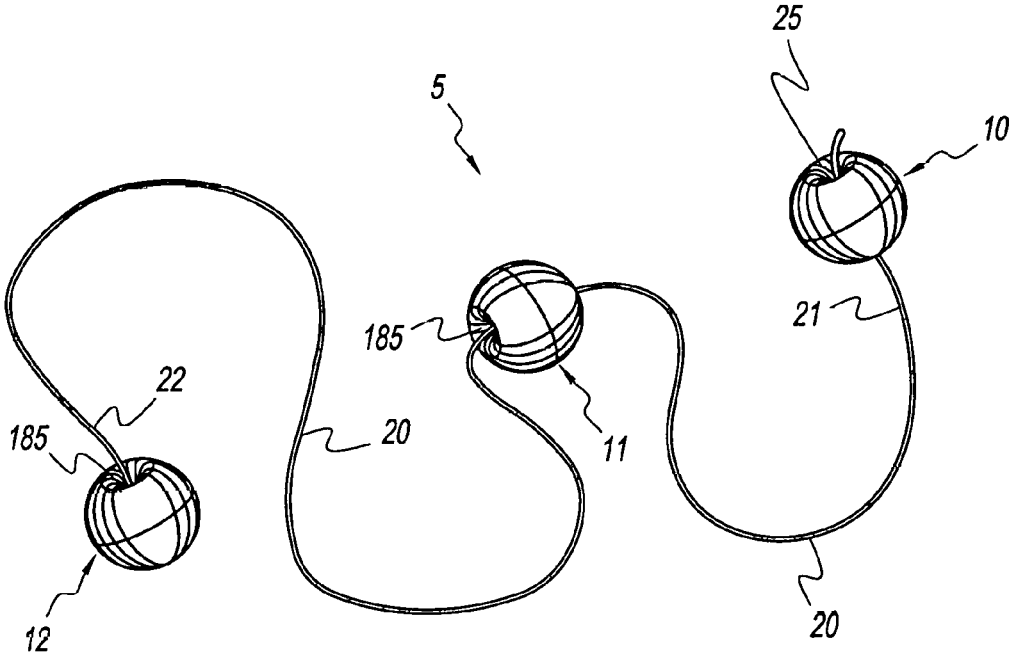
FIG. 1 shows a swinging bob toy according to the present invention.

As shown in FIG. 1, the swinging bob toy (5) of the present invention consists of three bobs (10), (11) and (12) constrained on a string (20). According to the preferred embodiment, each of the bobs (10), (11) and (12) has the same construction. Each of the bobs (10), (11) and (12) has a throughbore (185) through which the string (20) passes, thereby allowing the bobs (10), (11) and (12) to slide along the string (20). The bobs (10), (11) and (12) are constrained on the string (20) by a knot (25) at each end of the string (20) (only one knot (25) is visible in FIG. 1) having a diameter greater than the diameter of the throughbores (185) at their narrowest point. According to the preferred embodiment, the string (20) is a 2.25 mm diameter, fine-weave, circular-cross section nylon, and the throughbores (185) have a diameter at their narrowest point (which is on the equatorial plane) of 3.0 mm. Preferably, the string (20) has a width which is greater than 50%, more preferably greater than 60%, and still more preferably greater than 70% of the narrowest width of the throughbore (185). Furthermore, the string (20) has a width which, when compressed by a force equal to the weight of a bob (10), (11) and (12), is greater than 50%, more preferably greater than 60%, and still more preferably greater than 70% of the narrowest width of the throughbore (185). An important advantage of a string (20) of this diameter is that this allows a single overhand knot (25) at each end to secure the bobs (10), (11) and (12) to the string (20), and the string (20) can be easily tied and untied to allow length customization.

Figure 4A:
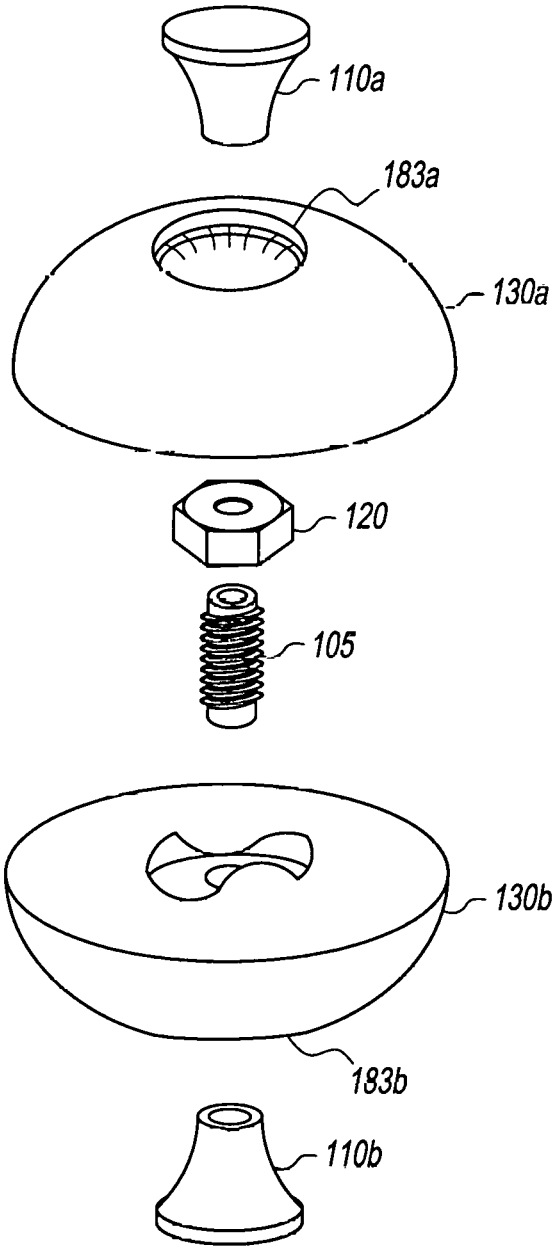
FIG. 4A shows an exploded view of a bob according to the preferred embodiment of the present invention, the bob being comprised of a lower flared throughbore sheath, a lower hemispheric mantle, a spindle threaded for the mounting of 10 mm hex nuts, a 10 mm hex nut, an upper hemispheric mantle, and an upper flared throughbore sheath.
Figure 4B:
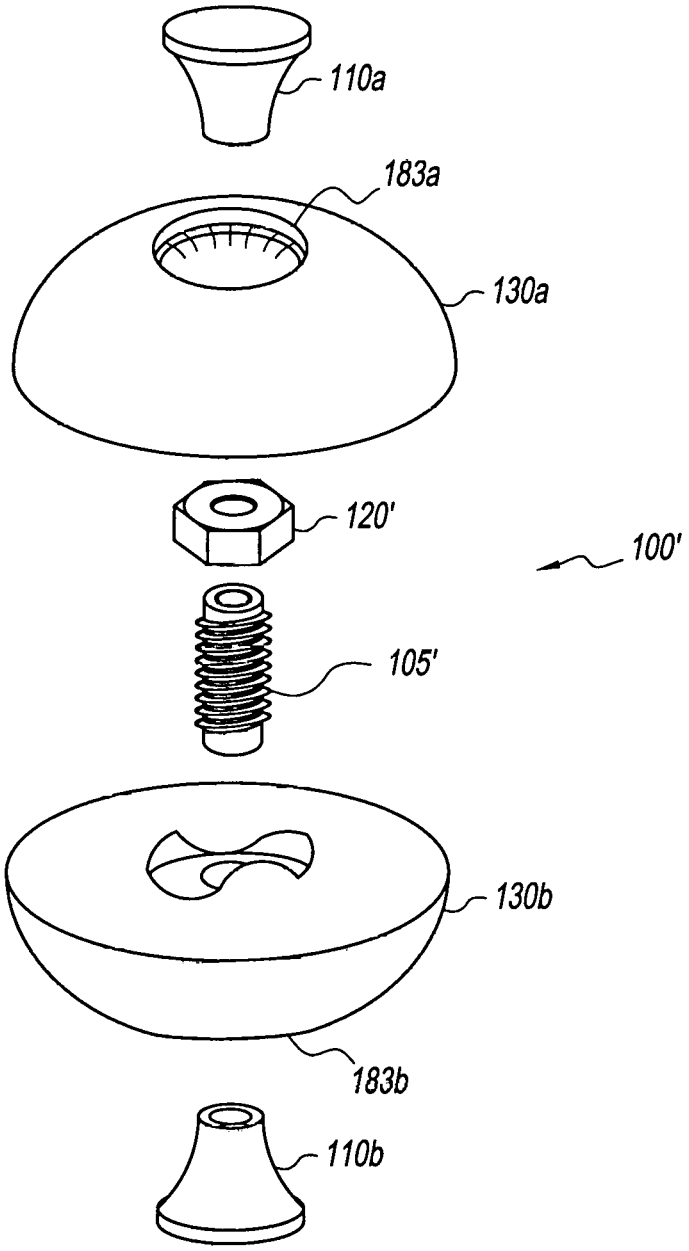
FIG. 4B shows an exploded view of a bob according to the preferred embodiment of the present invention, the bob being comprised of a lower flared throughbore sheath, a lower hemispheric mantle, a spindle threaded for the mounting of 12 mm hex nuts, a 12 mm hex nut, an upper hemispheric mantle, and an upper flared throughbore sheath.
Figure 4C:
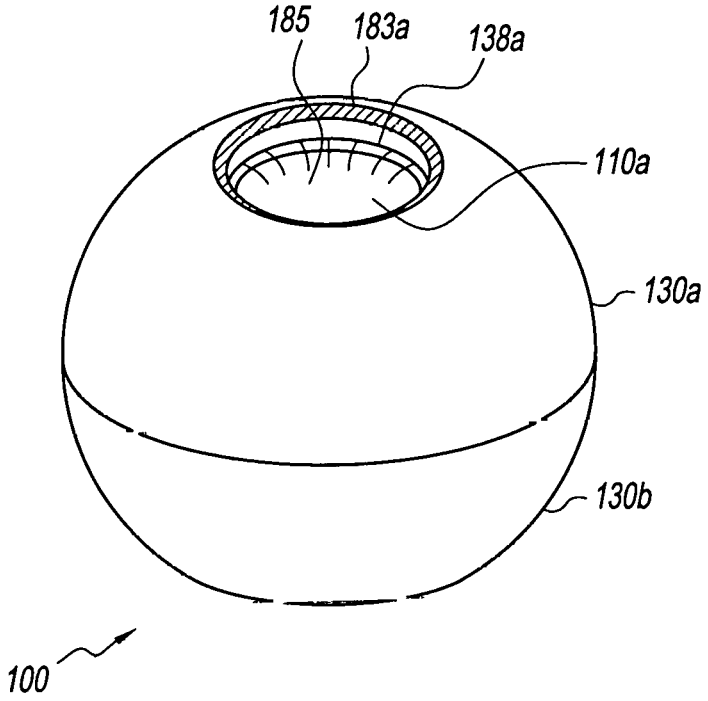
FIG. 4C shows an assembled bob according to the present invention, the bob being comprised of two mated hemispheric mantles, two flared throughbore sheaths (with only one visible in FIG. 4C), a threaded spindle (not visible in FIG. 4C), and a hex nut (not visible in FIG. 4C) mounted on the threaded spindle.

FIGS. 4A and 4B show exploded views of a bob (100) of the swinging bob toy (5) according to a preferred embodiment of the present invention, and FIG. 4C shows the assembled bob (100). (The bobs (10), (11), and (12) will be referred to generically or when discussing their component parts using the reference numeral 100.) In FIG. 4A, the bob (100) has a lower flared throughbore sheath (110*b*), a lower hemispheric mantle (130*b*), a spindle piece (105) threaded with 10 mm threads, a 10 mm hex nut (120), an upper hemispheric mantle (130*a*), and an upper flared throughbore sheath (110*a*). In FIG. 4B, the bob (100') has a lower flared throughbore sheath (110*b*), a lower hemispheric mantle (130*b*), a spindle piece (105') threaded with 12 mm threads, a 12 mm hex nut (120'), an upper hemispheric mantle (130*a*), and an upper flared throughbore sheath (110*a*). The hemispheric mantles (130*a*) and (130*b*) are preferably made of a soft, lightweight foam. (When geometric shapes are referred to in the present specification with the qualifier "roughly" it is meant that the shape would be recognized as having that geometric shape although it does not strictly have that specific geometric shape, and/or the surfaces may be extended or simplified to provide that specific geometric shape. For instance, the hemispheric mantle is considered to be roughly hemispheric because it is easily recognizable as a hemisphere, and in fact becomes a hemisphere when the spherical surface is extended to the poles and the undulating equatorial surface is flattened to span the equator as the surface of minimum area, i.e., a plane.)

Figure 5A:
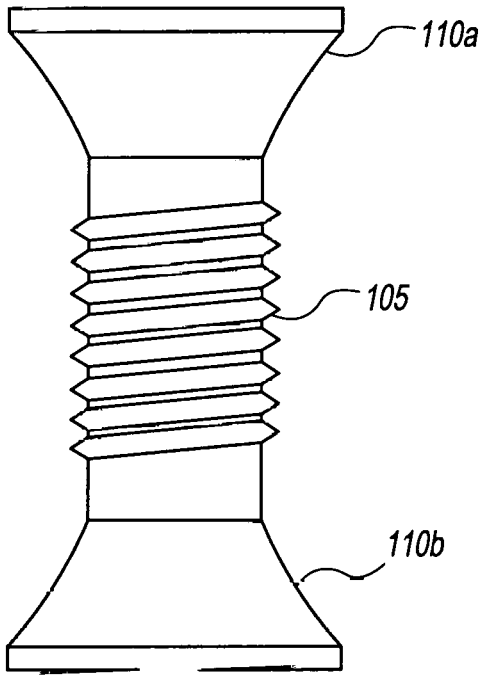
FIG. 5A shows the throughbore sheath components (i.e., the lower flared throughbore sheath, threaded spindle, and upper flared throughbore sheath) in an assembled configuration.
Figure 5B:
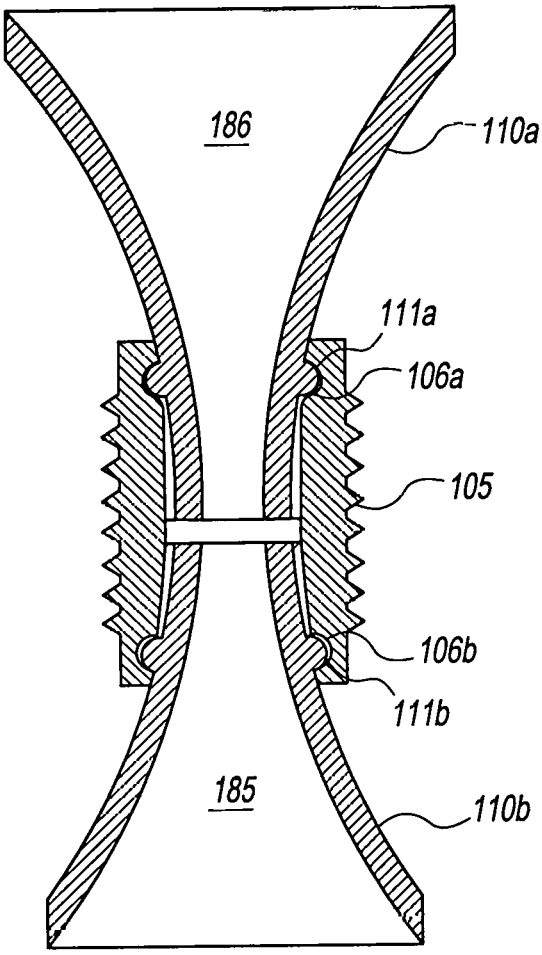
FIG. 5B shows a cross-sectional view of the throughbore sheath components (i.e., the lower flared throughbore sheath, threaded spindle, and upper flared throughbore sheath) in an assembled configuration.

FIG. 5A shows the three throughbore sheath components (i.e., the lower flared throughbore sheath (110*b*), the threaded spindle piece (105), and the upper flared throughbore sheath (110*a*)) in an assembled configuration. As shown in the cross-sectional view of the three throughbore sheath components (105), (110*b*) and (100*a*) of FIG. 5B, the threaded spindle (105) has an upper annular indent (106*a*) and the upper flared throughbore sheath (110*a*) has an annular protrusion (111*a*) which can mate with the upper annular indent (106*a*) to provide a removably-attachable snap joint between the threaded spindle (105) and the upper flared throughbore sheath (110*a*). Similarly, the threaded spindle (105) has a lower annular indent (105*b*) and the lower flared throughbore sheath (110*b*) has an annular protrusion (111*b*) which mates with the annular indent (106*b*) to provide a removably-attachable snap joint between the threaded spindle (105) and the lower flared throughbore sheath (110*b*). The assembled configuration of the throughbore components (105), (110*a*) and (110*b*) provides a smooth throughbore (185) through which the string (20) can pass.

Figure 6:
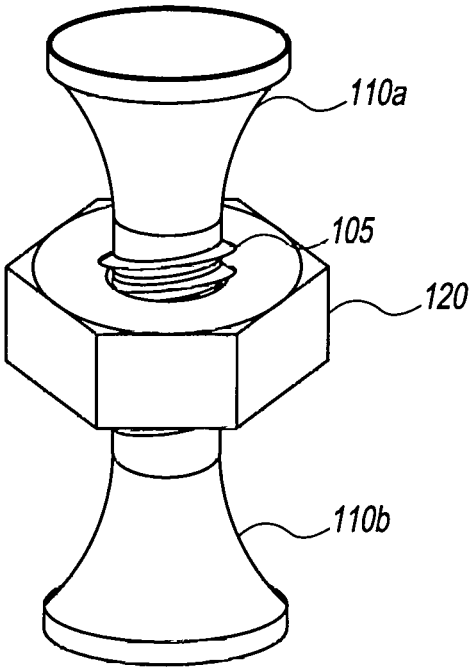
FIG. 6 shows the throughbore sheath components with a hex nut screwed onto the threaded spindle.

FIG. 6 shows the throughbore sheath assembly (105), (110*a*) and (110*b*) with a hex nut (120) screwed onto the threaded spindle (105). (To have screw mounted the hex nut (120) on the spindle (105), one of the flared throughbore sheaths (110*a*) or (110*b*) must have been removed and then replaced.) According to the preferred embodiment of the present invention the upper and lower flared throughbore sheaths (110*a*) and (110*b*) are made of a low coefficient of sliding friction, low specific gravity, non-elastomeric material, such as a hard plastic, and the threaded spindle (105) is made of an elastomeric material. (In the present specification, a material is considered elastomeric if it is flexible, compressible or bendable by a moderate manual force, and a material is considered non-elastomeric if it is stiff, uncompressible and unbendable under the application of a moderate manual force.) For smaller hex nuts (120), the wall thicknesses of the throughbore sheath components (105), (110*a*) and (110*b*) must also be small. Therefore durability of the throughbore sheath components (105), (110*a*) and (110*b*) may be a concern. The flexibility of the threaded spindle (105) contributes to the durability by helping to absorb shocks from impacts of the bobs (10), (11) and (12) with the surroundings.

Figure 7:
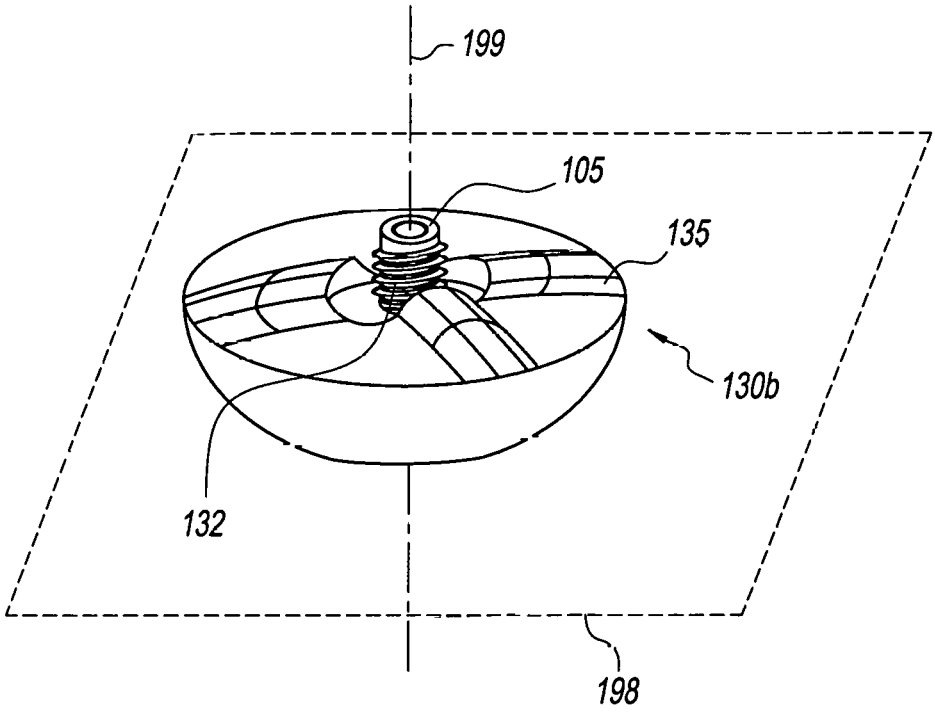
FIG. 7 shows a hemispheric mantle with an undulating equatorial surface and a central hexagonal hollow, with a threaded spindle mounted in the throughbore of the hemispheric mantel.

FIG. 7 shows the lower hemispheric mantle (130*b*) with the threaded spindle (105) in its mounted location on the hemisphere (130*b*). The threaded spindle (105) is mounted by attaching the lower flared throughbore component (110*b*) (not visible in FIG. 7) to the bottom end of the spindle (105) (as is shown in the bottom half of FIG. 5B) to sandwich the lower hemispheric mantle (130*b*) between the flared throughbore sheath (110*b*) and the threaded spindle (105). The lower mantle (130*b*) has an undulating equatorial surface (135) which, according to the preferred embodiment, has three-fold rotational symmetry. The undulating equatorial surface (135) has a mirror symmetry such that the peaks of the undulations have the same contours as the valleys of the undulations when mirrored across the equatorial plane (198) in combination with a 60° rotation about the throughbore axis (199). With the upper mantle (130*a*) having the same design as the lower mantel (130*b*), this allows the undulating equatorial surfaces (135) to abut over the entirety of the undulating surfaces (135). At the center of the undulating equatorial surface (135) is a hollow (132) which has six faces and a three-fold symmetry. The distance between opposing faces of the hollow (132) is slightly greater than the distance between opposing faces of the hex nut (120), and the depth of the hollow (132) relative to the equatorial plane (198) is greater than half the height of the hex nut (120), so that the hex nut (120) can be located in the hollows (132) between the mantles (130*a*) and (130*b*) when abutting as shown in FIGS. 4B and 9.

Figure 8:
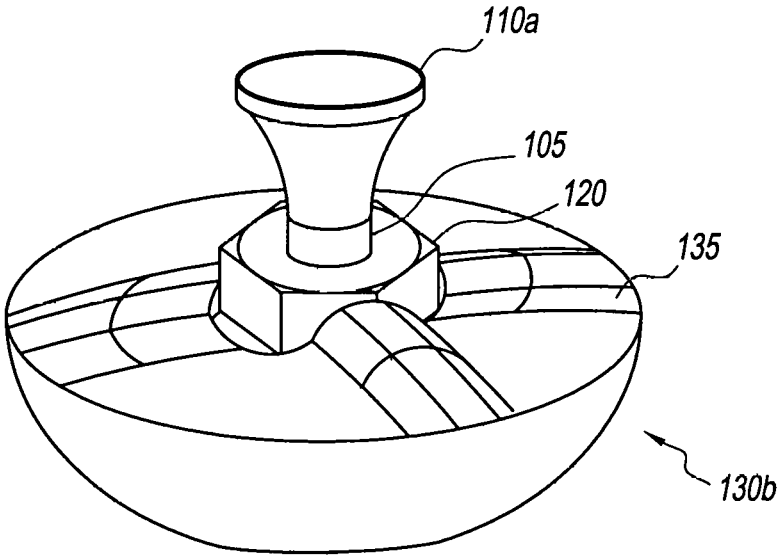
FIG. 8 shows the threaded spindle and hemispheric foam mantle of FIG. 7 with a hex nut mounted on the threaded spindle and located in the hexagonal hollow, and an upper flared throughbore sheath mounted in the threaded spindle.

FIG. 8 shows the lower hemispheric mantle (130*b*) with a hex nut (120) threaded onto the threaded spindle (105), the hex nut being located in the hollow (132) at the center of the hemispheric mantle (130*b*), and the upper flared throughbore sheath (110*a*) mounted in the threaded spindle (105). To have reached this configuration, the hex nut (120) was threaded on the isolated threaded spindle (105)—or on the threaded spindle (105) with the top flared throughbore sheath (110*a*) already attached to the threaded spindle (105)—the bottom hemisphere (130*b*) was sandwiched between a bottom flared throughbore sheath (110*b*) (not visible in FIG. 8) and the threaded spindle (105), and the top flared throughbore sheath (110*a*) was mounted at the top end of the threaded spindle (105) (if it had not already been mounted at the top end of threaded spindle (105)).

Figure 9:
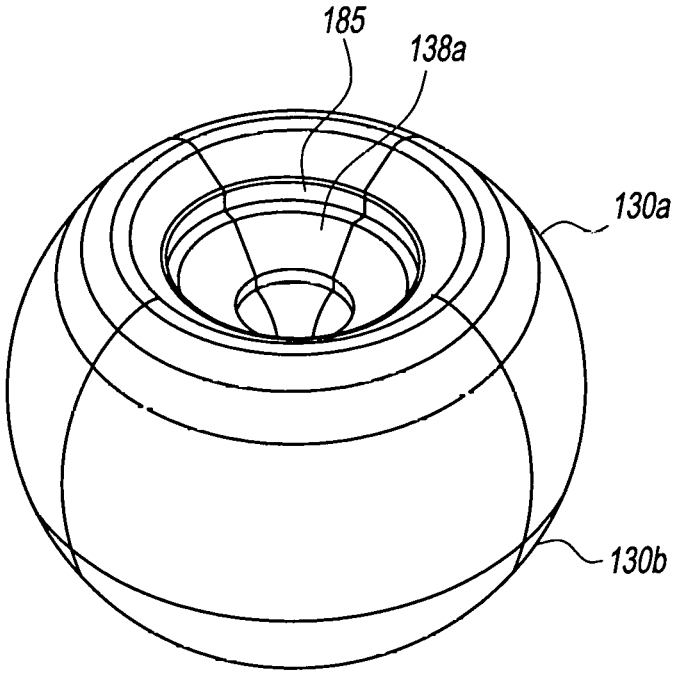
FIG. 9 shows two hemispheric mantles mated by the abutment of their undulating equatorial surfaces so as to provide an exterior surface which is substantially spherical except at the poles.
Figure 10A:
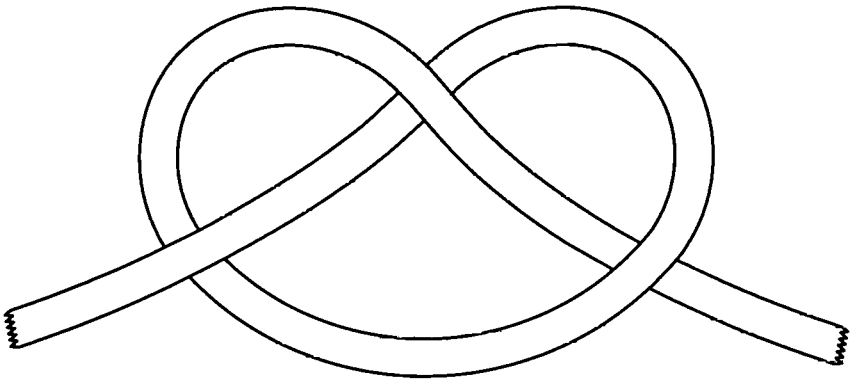
FIG. 10A shows an overhand knot in an untightened configuration.
Figure 10B:
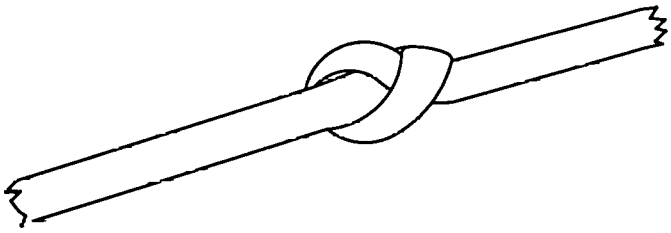
FIG. 10B shows an overhand knot in a tightened configuration.

FIG. 9 shows two hemispheric mantles (130*a*) and (130*b*) with the undulating equatorial surfaces (135) (not visible in FIG. 9) abutting with the peaks in the undulations of the undulating equatorial surface (135) of the upper hemispheric mantle (130*a*) mated with the valleys in the undulations of the undulating equatorial surface (135) of the lower hemispheric mantle (130*b*), and vice versa, to provide an outer surface which is spherical except at the poles. In the throughbore (185) of each hemispheric mantle (130*a*) and (130*b*) is an indent (138) into which a flared throughbore sheath (110) can be snugly located.

FIG. 4C shows an assembled bob (100) with two hemispheric mantles (130*a*) and (130*b*) abutting with the peaks in the undulations in one hemispheric mantle (130*a*) mated with the valleys in the undulations of the other hemispheric mantle (130*b*), and vice versa, to form a solid with a substantially spherical surface except at the poles. The abutting undulating equatorial surfaces (135) of the two hemispheric mantles (130*a*) and (130*b*) function to dissipate shear impact forces applied to the hemispheric mantles (130*a*) and (130*b*) so as to insulate the throughbore sheath assembly (105), (110*a*) and (110*b*) from impact forces. This prevents breaking or dislodgement of the throughbore sheath components (105), (110*a*) and (110*b*) as a result of impacts to the bobs (10), (11) and (12). The upper flared throughbore sheath (110*a*) is located in the indent (138*a*) of the throughbore (185) of the upper hemispheric mantle (130*a*), and the mouth of the upper flared throughbore sheath (110*a*) is recessed from the mouth (183*a*) of the throughbore (185) of the upper hemispheric mantle (130*a*) by between 1 mm and 3 mm. (Similarly, although not visible in FIG. 4C, the lower flared throughbore sheath (110*b*) is located in an indent (138*b*) of the throughbore (185) of the upper hemispheric mantle (130*b*) and the mouth of the lower flared throughbore sheath (110*b*) is recessed from the mouth (183*b*) of the throughbore (185) of the lower hemispheric mantle (130*b*) by between 1 mm and 3 mm.) Preferably, the flared throughbore sheaths (110*a*) and (110*b*) are recessed in the mouths (183*a*) and (183*b*) of the hemispheric mantles (130*a*) and (130*b*) by between $1/10^{th}$ and $1/40^{th}$ of the height of the throughbore (185), and more preferably between $1/20^{th}$ and $1/30^{th}$ of the height of the throughbore (185). According to the preferred embodiment of the present invention, the contour of the throughbore (185) of an assembled bob through the hemispheric mantles (130*a*) and (130*b*) and throughbore sheath assembly (105), (110*a*) and (110*b*) is smooth, i.e., jags or protrusions in the contour of the throughbore (185), particularly where the top of the upper flared throughbore sheath (110*a*) meets the upper hemispheric mantle (110*a*) or the bottom of the lower flared throughbore sheath (110*b*) meets the lower hemispheric mantle (110*b*) are minimized. According to the preferred embodiment of the present invention, the mouths (183*a*) and (183*b*) of the upper and lower hemispheric mantles (130*a*) and (130*b*) are textured to be roughened (as is indicated by the cross-hatching in FIG. 4C) to increase the coefficient of sliding friction in that region.

The upper edge of the upper flared sheath piece (110*a*) is below the upper edge of the mouth of the throughbore of the upper hemispheric mantle (110*a*) and the lower edge of the lower flared sheath piece (110*b*) is above the lower edge of the mouth of the throughbore of the lower hemispheric mantle (110*b*). Given that the upper and lower flared throughbore sheaths (110*a*) and (110*b*) are made of a non-elastomeric plastic to provide a low coefficient of friction with the string (20), and the hemispheric mantles (130*a*) and (130*b*) are made of a soft foam, the recessing of the flared throughbore sheaths (110*a*) and (110*b*) within the mouths of the throughbores of the hemispheric mantles (130*a*) and (130*b*) means that only the soft foam of the hemispheric mantles (130*a*) and (130*b*) will impact a player during play with the toy.

As shown in FIGS. 2A-2D and FIGS. 3A-3D, the toy (5) is operated by holding an end bob (12) and oscillating the hand (41) to cause the other end bob (10) and the middle bob (11) to orbit. The bobs (10) and (11) can describe a vertical orbit (90), as shown in FIGS. 2A-2D and FIGS. 3A-3D, or horizontal orbits, figure-eight type orbits or irregular paths.

Figure 2A:
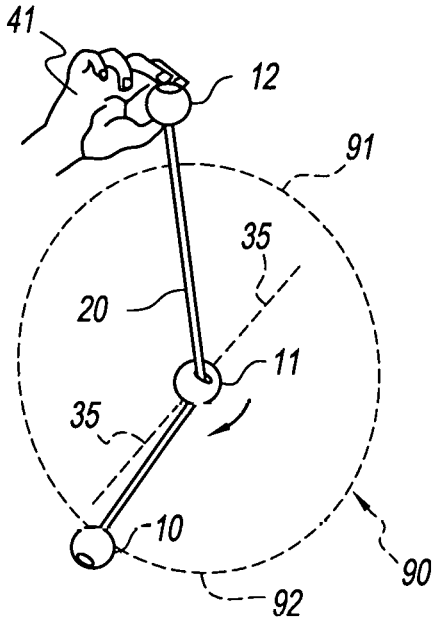
FIGS. 2A-2D show play with the swinging bob toy during a vertical orbit with the middle bob rotating in the vertical plane during the end bob's string pass.
Figure 2B:
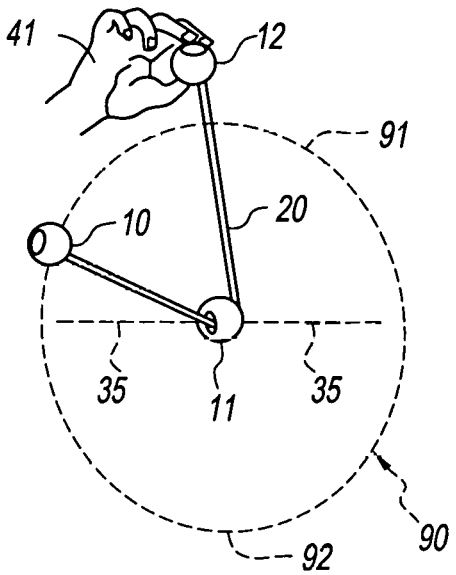
Figure 2C:
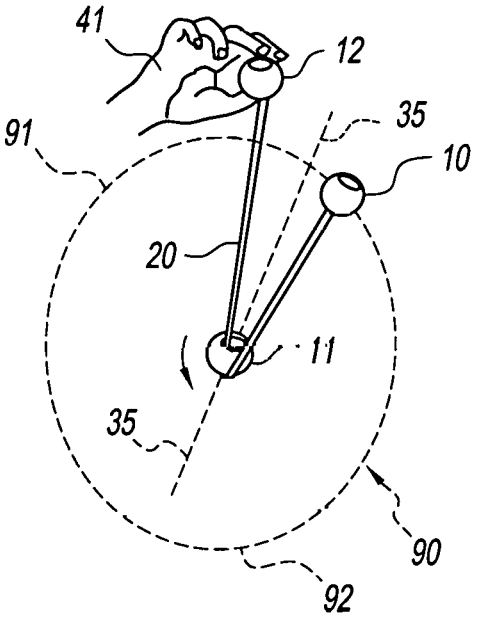
Figure 2D:
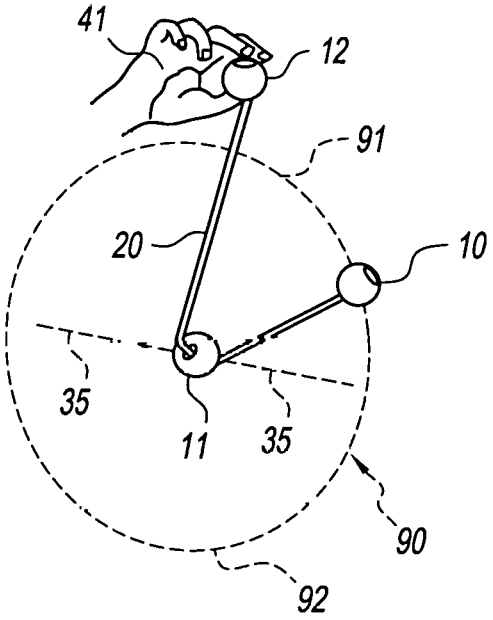

High-speed photography shows that the rotation of the middle bob (11) has two different modes of motion as the end bob (10) passes by the string (20) at the top of a vertical orbit (90), i.e., when the end bob (10) performs its "string pass." In a first mode of motion shown in FIGS. 2A-2D, the bore axis (35) of the middle bob (11) rotates to roughly follow the path of the orbiting end bob (10) as it (10) describes the lower half (92) of its orbit (90), as is indicated by the clockwise arrow next to the middle bob (11) in FIG. 2A. But as the orbiting end bob (10) begins the upper half (91) of its orbit (90), the rotation of the middle bob (11) slows and stops, as indicated by the lack of an arrow next to the middle bob (11) in FIG. 213. Then, during the upper half (91) of the orbit (90) of the orbiting end bob (10), the middle bob (11) reverses its direction of rotation and rotates counter-clockwise in the vertical plane, as is indicated by the counter-clockwise arrow next to the middle bob (11) in FIG. 2C. As the orbiting end bob (10) continues its descent, the middle bob (11) completes a roughly 180° rotation (which according to the lexography of the present specification will be termed the "180° string pass rotation"), and the bore axis (35) is roughly horizontal and points towards the side of the orbit (90) where the orbiting end bob (10) is currently descending, as is shown in FIG. 2D. (It should be noted that middle bob (11) acts as a sliding pivot point during vertical orbits, so that bob (11) may be described in the present specification reflective of its function as the "sliding-pivot" bob (11). This alternate naming is useful given that embodiments having only two bobs, and therefore no "middle" bob, may also be within the scope of the invention as per the appended claims.)

Figure 3A:
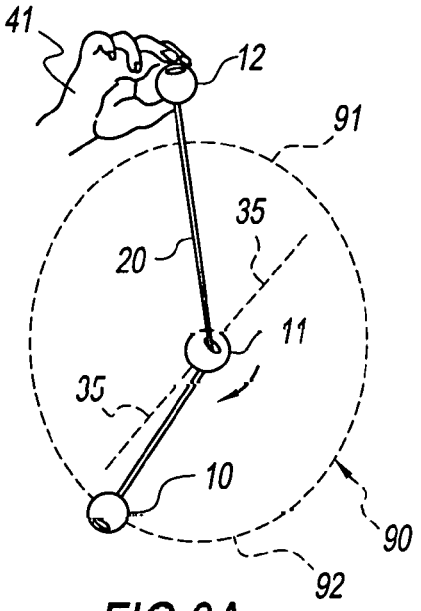
FIGS. 3A-3D show play with the swinging bob toy during a vertical orbit with the middle bob rotating in the horizontal plane during the end bob's string pass.
Figure 3B:
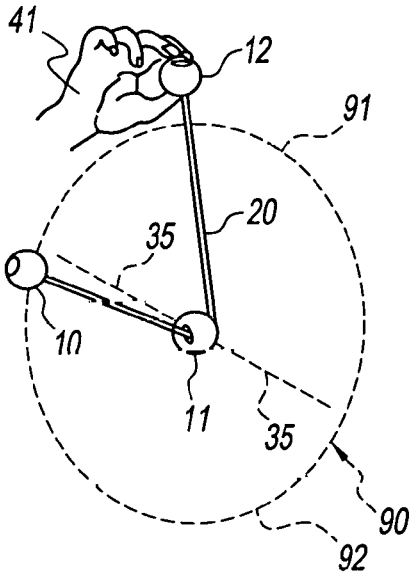

In a second mode of motion, the bore axis (35) of the middle bob (11) rotates to roughly follow the path of the orbiting end bob (10) as it (10) describes the lower half (92) of its orbit (90), as is indicated by the clockwise arrow next to the middle bob (11) in FIG. 3A. As the orbiting end bob (10) begins the upper half (91) of its orbit (90), the rotation of the middle bob (11) slows and stops, as indicated by the lack of an arrow next to the middle bob (11) in FIG. 3B. Then, during the upper half (91) of the orbit (90) of the orbiting end bob (10), the bore axis (35) of the middle bob (11) rotates in the horizontal plane as is indicated by the arrow next to the middle bob (11) in FIG. 3C. As the orbiting end bob (10) continues its descent, the middle bob (11) completes a roughly 180° rotation in the horizontal plane (which according to the lexography of the present specification will also be referred to as its "180° string pass rotation") so that the bore axis (35) is roughly horizontal and points towards the side of the orbit (90) where the orbiting end bob (10) is currently descending, as is shown in FIG. 3D.

Hybrid motions of the middle bob (11), combining or alternating between the first and second modes of motion, are also possible. For instance, in the course of the rotation of the middle bob (11) during the string pass of the orbiting end bob (10), the middle bob (11) may begin to rotate counter-clockwise in the vertical plane, then rotate in the horizontal plane, and then again rotate counter-clockwise in the vertical plane. Or the middle bob (11) may rotate around an axis that is mid-way between the vertical and horizontal planes.

While it has been appreciated in the prior art that a low sliding friction between the string and the throughbore of the middle bob is generally to be preferred, it has not been previously understood (see for instance U.S. Pat. No. 6,896,578, column 5, lines 57-58) that the smoothness of vertical orbits is benefited by also having regions of high friction in the throughbore (185). According to the present invention the throughbore (185) of the middle/sliding-pivot bob (11) has a non-uniform sliding friction. In particular, according to the present invention the throughbore (185) of the middle/sliding-pivot bob (11) has a central region which has a low coefficient of sliding friction, while the mouths of the throughbore (185) have a higher coefficient of sliding friction.

Figure 3C:
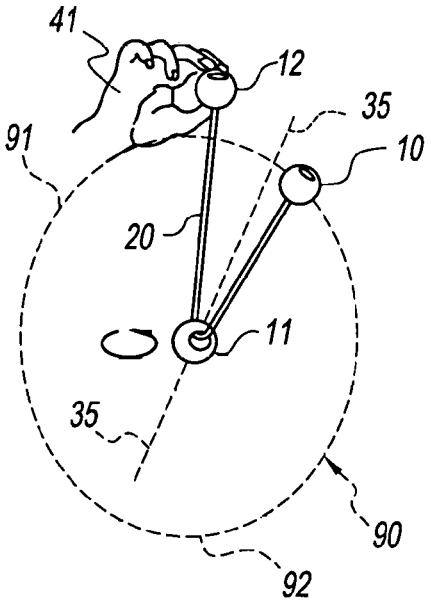
Figure 3D:
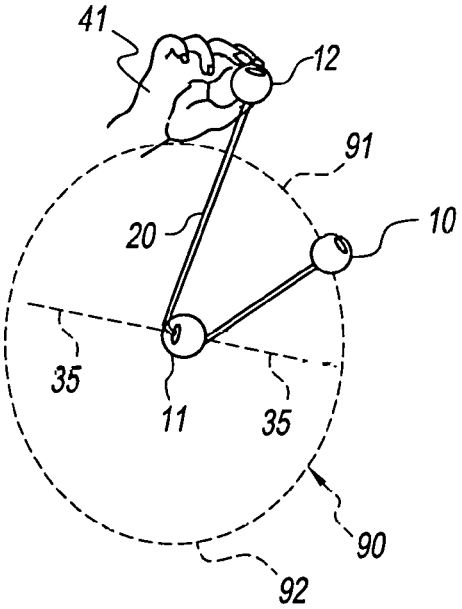

The benefit of this non-uniform sliding friction may be understood by revisiting FIGS. 2A-2D and 3A-3D and considering the sliding as well as the rotation of the middle bob (11). In particular, during the lower half (92) of the orbit (90) of the end bob (10), the end bob (10) slides downwards on the string (20) and it is therefore important to have a low coefficient of sliding friction to not inhibit the sliding of the middle bob (11) during this portion of the orbit (90). Because the string is relatively straight during this portion (92) of the orbit (i.e., because the angle the top leg of the string (20) with the bottom leg of the string (20) is greater than 90° and for a substantial period near 180°), the string (20) is predominantly in contact with the central portion of the throughbore (185) and the coefficient of sliding friction between the string (20) and the mouths of the throughbore (185) is not important. However, as the orbiting end bob (10) begins the upper half (91) of its orbit (90), the sliding of the middle bob (11) on the string (20) lessens. Then, during the upper half (91) of the orbit (90) of the orbiting end bob (10), the middle bob (11) does its 180° string pass rotation, as described in detail above. To produce a 180° string pass rotation, particularly in the horizontal plane as is depicted in FIG. 3C and described above, it is necessary for the string (20)—which now has an angle near 0° between the two legs of the string (20)—to produce torques on the middle bob (11) at the mouths of the throughbore (135), and therefore it is beneficial for there to be a high coefficient of sliding friction at the mouths of the throughbore (135) so that the torques can be effectively applied.

As discussed in U.S. Pat. No. RE34,208, U.S. Pat. No. 6,896,578, and U.S. Pat. No. 9,004,978 (which are incorporated herein by reference), it is beneficial to provide the middle/sliding-pivot bob (11) with a low moment of inertia about an axis of rotation in the equatorial plane of the bob (11) to facilitate the 180° string pass rotation. The moment of inertia I of a middle bob (11) about an axis of rotation in the equatorial plane (198) is given by $$I=\int \rho r^2 d\tau, \tag{1.1}$$

where ρ is density, r is distance from the axis of rotation (99), dτ is an infinitesimal volume element, and the integration is performed over volume. (The "moment of inertia" according to the lexography of the present invention is sometime referred to in other literature as the "radius of gyration.") As discussed in U.S. Pat. No. RE34,208, a crucial measure of the goodness of operation of a swinging bob toy (5) is the dimensionless goodness-of-operation ratio X given by $$X=(mh^2/I)^{1/2} \quad (1.2)$$

where m is the mass of a bob (10)/(11)/(12), and h is the height of the throughbore (185). If the goodness-of-operation ratio X is much greater than unity, the middle bob (11) can rotate rapidly in response to torques produced by the string (20), and so the string (20) will not snag around the middle bob (11) during the string pass and the motion will be smooth. However, if the goodness-of-operation ratio X is much less than unity, the middle bob (11) cannot rotate rapidly in response to torques produced by the string (20), and so the string (20) will tend to snag, or even tangle, around the middle bob (11) during the string pass, disrupting the orbital motions of the bobs (10) and (11) and inhibiting enjoyment of the toy (5).

To obtain a large goodness-of-operation ratio X, the mass of the middle bob (11) of the present invention is concentrated at the center of the bob (11) due to the hex nut (120) being made of metal (such as steel which has a specific gravity of around 7.8 g/cc) and the hemispheric mantles (130*a*) and (130*b*) being made of a material having a low specific gravity. Preferably, the hemispheric mantles (130*a*) and (130*b*) are made of an EVA foam having a specific gravity of between 0.10 and 0.20.

The hemispheric mantles (130*a*) and (130*b*) according to the preferred embodiment of the present invention have a diameter of 45 mm. The spindle (105) is threaded for 10 mm hex nuts. One or two hex nuts (120) may be screwed onto the spindle (105) to provide the central weighting necessary to lower the moment of inertia to provide smooth orbits. In particular, either one standard 10 mm hex nut, weighing 11.6 grams, or two "jam" 10 mm hex nuts, weighing 14.4 grams, can be put on the spindle (105). A children's version of the toy utilizes a single 10 mm hex nut (120) in each bob (10), (11) and (12), and since a pair of hemispheric mantles (130*a*) and (130*b*) weighs about 7 grams, each bob (10), (11) and (12) will weigh about 19 grams. As is shown in FIG. 4B, an adult version of the toy utilizes a spindle threaded for 12 mm hex nuts and a single 12 mm hex nut in each bob. One standard 12 mm hex nut weighs 17.3 grams and hence each bob (10), (11) and (12) will weigh about 25 grams. Because the flared throughbore sheaths (110*a*) and (110*b*) are removably attachable to the threaded spindle (105), a player has the option of replacing the single 12 mm hex nut with two 12 mm jam hex nuts, and since each 12 mm jam hex nut weighs 10.4 grams, each bob (10), (11) and (12) would then weigh roughly 28 grams. Players doing sophisticated tricks may want bobs (10), (11) and (12) this heavy.

Thus, it will be see that the improvements presented herein are consistent with the objects and advantages of the invention described above. While the above description contains many specificities, these should not be construed as limitations on the scope of the invention, but rather as exemplifications of preferred embodiments thereof. Many other variations are possible. For example: the hemispherical pieces need not be made of foam; the flared throughbore sheaths need not be recessed in the throughbores of the hemispheric mantles; the flared throughbore sheaths may be recessed to a greater or lesser extent than the particular embodiment described; the threaded spindle may be designed to mount another type of hardware component for the central weighting, such as one or more washers; the particular dimensions of the components may be altered; components such as the hemispheric mantles may not have three-fold symmetry; the equatorial surfaces of the hemispheric mantles may not be undulating; each of the bobs need not have the same construction; the threaded spindle may be made of a non-elastomeric material; a throughbore may not have a non-uniform coefficient of sliding friction or the coefficient of sliding friction may not be non-uniform as described; there may be other means for attachment of the threaded spindle to the upper and lower flared throughbore sheaths, such as a friction fit, or a threaded screw attachment; the attachment of the threaded spindle to the upper and lower flared throughbore sheaths may not be a removable attachment; the spindle may have a non-metric threading; etc. Accordingly, the scope of the invention should be determined not by the embodiments illustrated, but by the appended claims and their legal equivalents.

What is claimed is:

1. A swinging bob toy comprising:

a tethering means, a first bob, and a second bob having a throughbore, said tethering means passing through said throughbore and said second bob being slideable on said tethering means, said first bob being constrained to said tethering means between a first end of said tethering means and said second bob, said second bob having an elastomeric exterior surface and a non-elastomeric throughbore sheath, said throughbore sheath providing a non-elastomeric central region of said throughbore, said elastomeric exterior surface providing a first elastomeric region of said throughbore at a first end of said throughbore and a second elastomeric region of said throughbore at a second end of said throughbore, wherein said first and second elastomeric regions of said throughbore each have a height along the longitudinal axis of said throughbore of between $1/10^{th}$ and $1/40^{th}$ of a height of said throughbore.

2. The swinging bob toy of claim 1 wherein said height of said first and second elastomeric regions of said throughbore along the longitudinal axis of said throughbore is between $1/20^{th}$ and $1/30^{th}$ of said height of said throughbore.

3. A swinging bob toy comprising:

a tethering means, a first bob, and a second bob having a throughbore, said tethering means passing through said throughbore and said second bob being slideable on said tethering means, said first bob being constrained to said tethering means between a first end of said tethering means and said second bob, said second bob having an elastomeric exterior surface and a non-elastomeric throughbore sheath, said throughbore sheath providing a non-elastomeric central region of said throughbore, said elastomeric exterior surface providing a first elastomeric region of said throughbore at a first end of said throughbore and a second elastomeric region of said throughbore at a second end of said throughbore, wherein said throughbore sheath has a first flared end piece located on a first side of said throughbore, a second flared end piece located on a second side of said throughbore, and a central piece into which said first flared end piece and said second flared end piece are mountable.

4. The swinging bob toy of claim 3 wherein said first flared end piece and said second flared end piece are removably mounted in said central piece by a snap fit.

5. The swinging bob toy of claim 3 wherein said central piece has a threaded exterior and mounted on said threaded exterior is a metal hex nut.

6. A swinging bob toy comprising a tethering means, a first bob, and a second bob having a first elastomeric hemispheric mantle with a first throughbore along a first polar axis normal to a first equatorial surface, said first elastomeric hemispheric mantle having a first hollow extending to said first equatorial surface, said first hollow being centered along said first polar axis, a second elastomeric hemispheric mantle with a second throughbore along a second polar axis normal to a second equatorial surface, said second elastomeric hemispheric mantle having a second hollow extending to said first equatorial surface, said second hollow being centered along said second polar axis, a weight having dimensions small enough to fit in said first and second hollows when said first and second equatorial surfaces of said first and second elastomeric hemispheric mantles abut, a first non-elastomeric flared throughbore sheath, a second non-elastomeric flared throughbore sheath, and a securing mechanism for securing said first non-elastomeric flared throughbore sheath in said first throughbore, securing said second non-elastomeric flared throughbore sheath in said second throughbore, and securing said first and second elastomeric hemispheric mantles together with said first and second equatorial surfaces abutting and said weight in said first and second hollows.

7. The swinging bob toy of claim 6 wherein said weight is a hex nut and said securing mechanism includes outside threading for screw mounting of said hex nut, first attachment means for attaching to said first non-elastomeric flared throughbore sheath, second attachment means for attaching to said second non-elastomeric flared throughbore sheath, and a central throughbore, said central throughbore, a throughbore of said first non-elastomeric flared throughbore sheath, and a throughbore of said second non-elastomeric flared throughbore sheath forming a continuous throughbore through said bob when said securing mechanism is attached via said first attachment means to said first non-elastomeric flared throughbore sheath and said securing mechanism is attached via said second attachment means to said second non-elastomeric flared throughbore sheath, said tethering means passing through said continuous throughbore and said second bob being slideable on said tethering means, and said first bob being constrained to said tethering means between a first end of said tethering means and said second bob.

8. The swinging bob toy of claim 7 wherein said first attachment means is a first removably-securable snap joint and said second attachment means is a second removably-securable snap joint.

9. The swinging bob toy of claim 7 wherein said first and second equatorial surfaces of said first and second hemispheric mantles undulate with a mirror symmetry when rotated by a rotation angle about their polar axis so as to mate.

10. The swinging bob toy of claim 9 wherein said rotation angle is 60°.

11. A swinging bob toy comprising:

a tethering means, a first bob, and a second bob having a throughbore, said tethering means passing through said throughbore and said second bob being slideable on said tethering means, said first bob being constrained to said tethering means between a first end of said tethering means and said second bob, a first width of said tethering means along a region of said tethering means on which said second bob is slideable being greater than 50% of a second width of said throughbore at its narrowest.

12. The swinging bob toy of claim 11 wherein said first width is greater than 60% of said second width.

13. The swinging bob toy of claim 11 wherein said tethering means has a third width when compressed transversely by a force equal to a weight of said first bob, and a ratio of said third width to said second width is greater than 50%.

14. The swinging bob toy of claim 13 wherein said ratio of said third width to said second width is greater than 60%.

* * * * *